United States Patent [19]

Mohr

[11] Patent Number: 4,856,097

[45] Date of Patent: Aug. 8, 1989

[54] APPARATUS FOR INDUCTION HEATING OF ELECTRICALLY CONDUCTIVE METAL WIRE AND STRIP

[76] Inventor: Glenn Mohr, P.O. Box 52, Linthicum, Md. 21090

[21] Appl. No.: 174,868

[22] Filed: Mar. 29, 1988

[51] Int. Cl.[4] ..... H05B 6/10

[52] U.S. Cl. ..... 219/10.61 R; 219/10.491; 219/10.75; 219/10.79

[58] Field of Search ..... 219/10.61 R, 10.491, 219/10.492, 10.61 A, 10.57, 10.67, 10.75, 10.79, 469, 470, 471

[56] References Cited

U.S. PATENT DOCUMENTS

| | | | |
|---|---|---|---|
| 2,675,461 | 4/1954 | Leonard | 219/10.61 R |
| 3,546,433 | 12/1970 | Johnson | 219/469 |
| 3,965,321 | 6/1976 | Brinkmann et al. | 219/10.491 |
| 4,350,861 | 9/1982 | Pouillange et al. | 219/10.61 R |
| 4,472,616 | 9/1984 | Maurice et al. | 219/10.79 X |
| 4,481,397 | 11/1984 | Maurice et al. | 219/10.61 R |
| 4,668,851 | 5/1987 | Küpper | 219/10.61 R |
| 4,761,527 | 8/1988 | Mohr | 219/10.79 X |

*Primary Examiner*—Philip H. Leung

*Attorney, Agent, or Firm*—Charles E. Brown; Charles A. Brown

[57] ABSTRACT

This relates to an apparatus for progressively heating wire and strip from one end to the opposite end thereof for the purpose of annealing the wire and strip or like function. The wire or strip is wound in a spiral groove formed in a drum which is formed of electrically conductive metal and is mounted in conjunction with a coil assembly to function as an armature of a D.C. generator. The power supplied to the coil assembly will be constant and the drum and the wire or strip wound thereon will function as a shorted armature of such D.C. generator so that all electrical energy induced into the drum and the wire will immediately be converted to heat energy. The drum is rotated at a selective speed with the rate of rotation of the drum controlling the amount of heat energy induced into the wire or strip.

4 Claims, 1 Drawing Sheet

APPARATUS FOR INDUCTION HEATING OF ELECTRICALLY CONDUCTIVE METAL WIRE AND STRIP

This invention relates in general to new and useful improvements in an apparatus for heating for metal wire and strip, and most particularly to an apparatus for induction heating of electrically conductive metal wire and strip.

The apparatus of this invention basically utilizes the induction heating concept set forth in my co-pending application Ser. No. 784,499 filed Oct. 4, 1985, now U.S. Pat. No. 4,761,527, wherein it is taught that a workpiece may be electrically heated by inducing into the workpiece a D.C. current with the workpiece functioning as a shorted armature of a D.C. generator.

In accordance with this invention, there is provided an apparatus for heating wire and strip of an electrically conductive metal as it passes around a drum with the heating being progressively from one end of the wire and strip to the other. A typical purpose of heating such wire and strip would be an annealing function.

In accordance with this invention, there is provided a drum which is so mounted with respect to a coil as to function as the armature of a D.C. generator when the drum is rotated. The exterior surface of the drum is provided with a spiral groove of a cross section in accordance with the wire or strip which is to be heated with the spiral groove extending generally from one end of the drum to the other. The drum is preferably of a hollow construction and of a wall thickness wherein it may be easily heated and at the same time will supply sufficient heat to maintain the desired heated temperature of the wire and strip. The wire and strip, when mounted on the drum, together with the drum form a dead short armature of a D.C. generator whereby all electrical energy induced into the drum and wire or strip is converted into heat energy.

With the above and other objects in view that will hereinafter appear, the nature of the invention will be more clearly understood by reference to the following detailed description, the appended claims, and the several views illustrated in the accompanying drawing.

Figure 1:
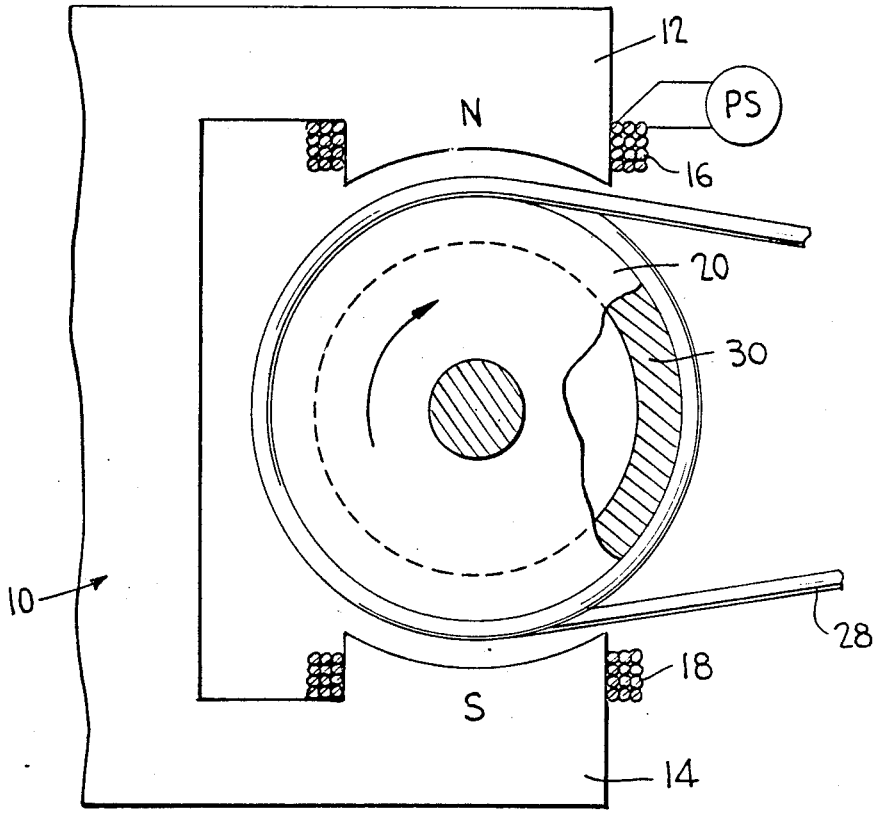
FIG. 1 is a schematic side elevational view with parts broken away and shown in section of the apparatus formed in accordance with this invention.
Figure 2:
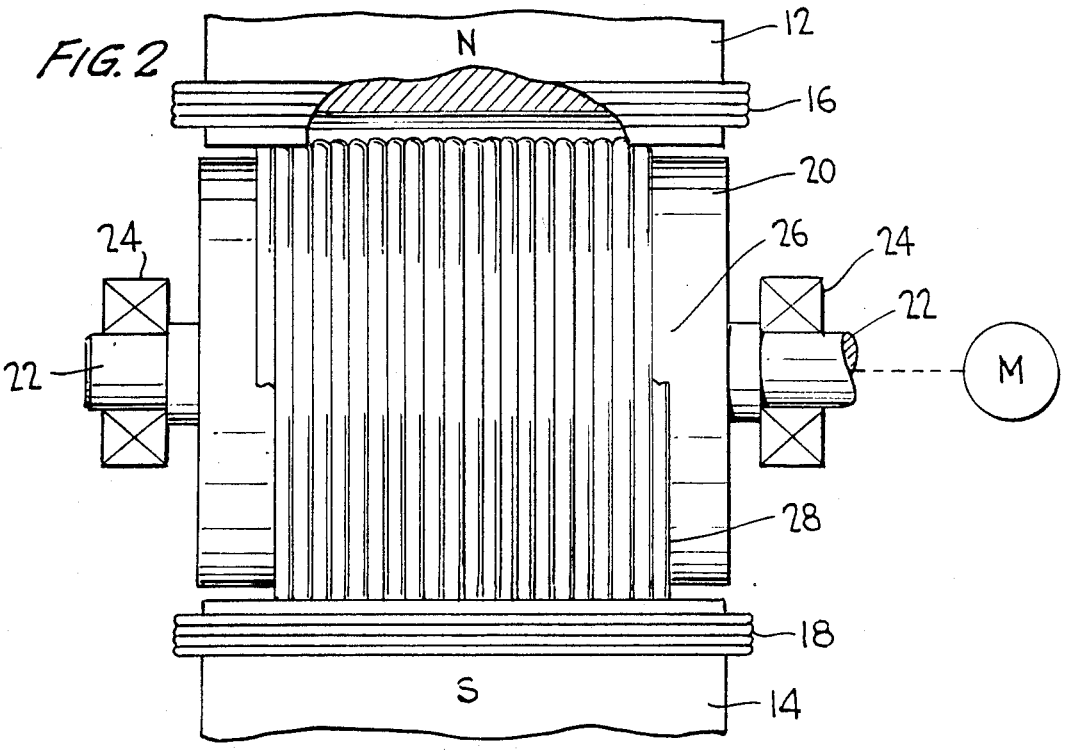
FIG. 2 is a front elevational view of the apparatus of FIG. 1 with parts broken away and shown in section.

Referring now to the drawings in detail, it will be seen that there is illustrated an induction coil assembly, generally identified by the numeral 10. The induction coil assembly 10 includes two interconnected poles 12, 14 which are disposed in opposed spaced relation and which have suitably wound thereon a pair of coils 16, 18. The coils 16, 18 are connected to a suitable power supply PS which is preferably a low voltage, high amperage D.C. power supply.

An armature in the form of an electrically conductive metal drum 20 is mounted between the poles 12, 14 in close proximity to the two poles. At this time it is to be noted that the length of the drum 20 corresponds generally to the length of the poles 12, 14.

The drum 20 is mounted for rotation by way of stub shafts or trunnions 22 which are suitably journalled in bearings 24. One of the trunnions 22 is coupled to an electric motor M for the rotation of the drum 20 at a selected speed.

It is to be noted that the drum 20 has formed in the exterior surface thereof a spiral groove 26 which will be of a cross section corresponding to the wire or strip which is to be heated. In the illustrated embodiment of the invention, an elongated wire 28 is entrained about the drum 20 and due to the provision of the spiral groove 26, as the drum 20 rotates, the wire 28 will be simultaneously fed into and from opposite ends of the drum 20.

As is best illustrated in FIG. 1, the drum 20 is preferably of a hollow construction having a cylindrical wall 30. The wall 30 is of a selected thickness which enables the drum to be heated with ease while at the same time providing for sufficient heat transfer to the wire or strip which is being heated.

At this time it is most particularly pointed out that the wire or strip which is to be heated is formed of an electrically conductive metal and that portion thereof which is temporarily wound around the drum 20, together with the drum 20 forms, in conjunction with the coil assembly 10, a D.C. generator. The drum 20 and the wire 28 or strip wound thereon function as the armature of such D.C. generator and due to the fact that the drum and the wire strip wound thereon form a dead short, such armature is a dead shorted armature. The net result is that all electrical energy induced into the drum 20 and the wire or strip is immediately converted into heat energy.

Further, and most particularly, it is to be understood that the electrical energy supplied to the coils 16, 18 will be constant in that the amount of heat energy induced into the combination of the drum 20 and the wire or strip wound thereon will be directly dependent upon the rate of rotation of the drum 20.

Under the circumstances, it will be seen that there can be controlled heating of the wire or strip as it passes around the drum 20. Preferably, the wire or strip is heated for the purposes of annealing the same although there are other reasons for heating the wire or strip, for example, when the wire or strip is to have a plastic insulating coating extruded thereon. It is to be understood that the wire or strip will be supplied in coil form and it will be progressively heated from one end to the other end.

Although only a preferred embodiment of the invention has been specifically illustrated and described herein, it is to be understood that minor variations may be made in the heating apparatus without departing from the spirit and scope of the invention as defined by the appended claims.

I claim:

1. Apparatus for induction heating of electrically conductive metal wire and strip, said apparatus comprising a metal drum having a spiral groove external surface to provide a multiple turn continuous path for wire and strip from one end portion of said drum around said drum to an opposite end portion of said drum, means mounting said drum for rotation, drive means connected to said drum for rotating said drum at a selected rate, coil means fixedly positioned in cooperating relation to said drum to provide a magnetic field in which said drum rotates, said coil means being coupled to a constant D.C. power supply providing a constant D.C. field strength, and heating is controlled by the speed of rotation of said drum.

2. Apparatus according to claim 1 wherein said drum and wire and strip entrained on said drum form a short circuited armature of a D.C. generator.

3. Apparatus according to claim 1 wherein said drum is hollow and has a wall thickness selected for ease of heating and heat storage.

4. Apparatus according to claim 1 wherein said coil means is elongated and includes poles of a dimensions generally corresponding to the length of said drum.

* * * * *